US007195100B2

(12) United States Patent
Shechter

(10) Patent No.: US 7,195,100 B2
(45) Date of Patent: Mar. 27, 2007

(54) SYSTEM AND METHOD FOR AN ESCAPABLE MULTISTORY BUILDING

(76) Inventor: Nir Shechter, Moshav Revaia 17, Beit Shean Valley, 10920 (IL)

( * ) Notice: Subject to any disclaimer, the term of this patent is extended or adjusted under 35 U.S.C. 154(b) by 269 days.

(21) Appl. No.: 10/189,531

(22) Filed: Jul. 8, 2002

(65) Prior Publication Data

US 2003/0106742 A1 Jun. 12, 2003

Related U.S. Application Data

(60) Provisional application No. 60/339,306, filed on Dec. 12, 2001.

(51) Int. Cl.
*A62B 1/06* (2006.01)
*A62B 1/20* (2006.01)
*A47L 3/04* (2006.01)

(52) U.S. Cl. ..... 182/82; 182/3; 182/5; 182/37; 182/36; 182/53; 182/57; 182/60; 182/100; 182/179.1; 182/231; 182/232

(58) Field of Classification Search ..... 182/3–4, 182/5–9, 231–232, 36–39, 53–62, 70, 76, 182/82–100, 115–116, 123, 152, 179.1–186.9; 52/27, 32–33, 79.1, 79.4, 79.7–79.9, 80.1
See application file for complete search history.

(56) References Cited

U.S. PATENT DOCUMENTS 3,414,081 A * 12/1968 Wedvik ..... 182/160
3,459,276 A * 8/1969 Kiichiro ..... 182/72
3,759,346 A * 9/1973 Brda ..... 182/7
3,760,901 A * 9/1973 Hynes ..... 182/7
3,844,377 A * 10/1974 Wilkins ..... 182/6
3,880,255 A * 4/1975 Huntlkey ..... 182/5
4,161,998 A * 7/1979 Trimble ..... 182/190
4,211,306 A * 7/1980 Brenner ..... 182/76
4,243,119 A * 1/1981 Rossey, Sr. ..... 182/96
4,287,963 A * 9/1981 Coxsey ..... 182/231
4,381,046 A * 4/1983 Landem ..... 182/70
4,425,982 A * 1/1984 Kibbie ..... 182/36
4,440,261 A * 4/1984 Clark ..... 182/3
4,538,704 A * 9/1985 Forrest ..... 182/10
4,623,038 A * 11/1986 Stancato ..... 182/239
4,640,388 A 2/1987 Walborn
4,702,347 A * 10/1987 Nilsen ..... 182/8
4,703,831 A * 11/1987 Forrest et al. ..... 182/3
5,392,877 A * 2/1995 Shahin et al. ..... 182/82
5,467,841 A * 11/1995 Krumal ..... 182/70
5,651,331 A * 7/1997 Cleri, Jr. ..... 119/484
5,884,726 A 3/1999 Chiu et al.
5,913,383 A 6/1999 Tseng
6,182,789 B1 2/2001 Okamura
6,550,580 B1 * 4/2003 Roches ..... 182/191

* cited by examiner

*Primary Examiner*—Jeanette Chapman

(57) ABSTRACT

A system and method for allowing escape of many persons from a multistory building over a short period of time. The method and system include strategic placement and use of anchor points and components in conjunction with escape kits or devices so as to allow increased efficiency and safety of escape from the building for a plurality of persons in a coordinated manner, including escape of multiple escapees simultaneously or near simultaneously. The system and method include determining a strategic escape plan and configuration that incorporates consideration of building features, including features possibly interfering with escape routes, and three dimensional aspects of both building characteristics and anchor and escape kit and device features.

34 Claims, 22 Drawing Sheets

700

SYSTEM AND METHOD FOR AN ESCAPABLE MULTISTORY BUILDING

This application claims priority from U.S. Provisional Patent Application Ser. No. 60/339,306 filed Dec. 12, 2001. The entirety of that provisional patent application is incorporated herein by reference.

BACKGROUND OF THE INVENTION

1. Field of the Invention

The present invention relates generally to a system and method for escaping a building, and more specifically to a system and method for escaping a multistoried building using strategically placed escape devices that allow escapees to escape without interference along determined escape routes.

2. Related Art

U.S. Pat. No. 6,182,789 B1 to Okamura describes an escape device for escaping from a building or other high area in an emergency and comprises a worm gear mechanism driven by an electric motor and operatively coupled to a reel having a length of high tensile line wound around it, arranged within a casing, and a belt connected to the casing for supporting a person's body. The worm gear mechanism rotates the reel, feeding out the line, and thereby lowering the user to a safe location below.

U.S. Pat. No. 5,884,726 to Chiu et al. describes an emergency escape device composed of a cap, a cylindrical main body, a conical movable body, and a rope. The top end of the rope is fastened with a safety hook engageable with a fixed object located in a building. The main body is provided with a plurality of retainers for holding carriers intended for use in carrying escapees.

U.S. Pat. No. 5,913,383 to Tseng describes a fire escape device for lowering people from a high-rise, including a casing having a hanger for hanging on a support in a high-rise from which the user is going to escape, a driving pulley mounted inside the casing, a cable wound around the driving pulley and having an outer end extended out of the casing, a harness adapted for securing the user to the outer end of the cable, a friction disk having a corrugated track, a chain transmission turned by the driving pulley to rotate the friction disk, and spring-supported damping means installed in the casing and pressed on the corrugated track of the friction disk to impart a damping resistance to the driving pulley through the friction disk when the user descends from the high-rise.

U.S. Pat. No. 4,640,388 to Walborn describes an escape device that uses multiple discardable cable spools. The escape device casing is fitted to a window ledge by front and rear locking feet. A person attempting to escape uses hand grips for positioning below the roller spool for the cable at a position spaced from the outside wall of the building. As the person descends, the rate of descent is controlled by friction brakes within the casing. Upon reaching the ground, a door in the casing can be opened and the cable spool removed and replaced with a fresh cable spool, thus eliminating the necessity for rewinding the old cable.

3. Background of the Technology

In recent times, technological and economic progress has led to the advancement of multistory buildings. These buildings allow large numbers of people to be located in a small footprint area, but these buildings present challenges when disaster strikes because a quick and efficient evacuation is difficult. In the art, methods and devices have been presented, focusing on allowing an individual to escape from a multistory building. These devices and methods include chutes, stairs, parachute, and rappel-based systems, as well as methods of use thereof.

Generally, rappel-based systems are effective because they are compact and cheap. These systems often include hooks or poles attached to specific points to serve as anchors, which allow attachment of one or more rappeling components, referred to as kits, which allow the user to descend at a controlled rate from the hooks or poles. In the prior art, such kits generally include ropes or cables, harness devices, braking devices, and connectors for attachment to anchors.

The prior art focuses on methods and systems for individual users (referred to herein interchangeably as "escapees") to attach the kit to an anchor, such as or including a pole, to attach the kit to themselves, and then to exit the building from high above the ground at a controlled rate.

The prior art has failed to address a number of issues, including, but not limited to, the use and placement of multiple escape devices on the outer surfaces of a building and strategic use issues or problems relating to use by many simultaneous or near simultaneous users. For example, while the prior art has focused on the escape of an individual or a plurality of escapees from one window, it has not focused on many practical problems with such escapes, such interference that can occur with as the escape of many people from a multistoried building in a short amount of time over many escape routes.

SUMMARY OF THE INVENTION

The present invention solves the unmet needs of the prior art by providing a system and method for allowing multiple users to escape in a coordinated manner from a multistory building over a short period of time. One embodiment of the present invention includes a method and system for placement of anchors and uses attachable kits in a coordinated plan for the exit of many users from a building. The method and system of the present invention is usable with a wide range of individually designed devices for escape, including many of the anchor and kit devices of the prior art.

The system of an embodiment of the present invention includes a plurality of strategically located anchor components or anchor points, which are used with a plurality of individual escape kits or other escape devices used with the anchor components or anchor points. This combination of selected placement of anchor components or anchor points and escape kits or devices allows efficient, coordinated, and safer evacuation of a building by a large number of people over a short period of time than the individual escape devices of the prior art.

The method of an embodiment of the present invention includes one or more of the following functions: 1) identifying any interfering features on the building from which escape is planned; 2) identifying possible exits for use for escape from the building, with the possible exits being identified in one embodiment of the present invention based on the planning for or around the presence of interfering features; 3) identifying possible escape areas (EAs) based on the identified exits; 4) determining an escape device configuration; and 5) placing escape devices according to the determined configuration.

Embodiments of the present invention include a variety of escape patterns and EA determinations based on not only determined exits and interfering features, but also building shape and design. In an embodiment of the present invention, the determination of EAs and an escape configuration includes use of three dimensional features of anchor components and placement location with regard to exits, along with characteristics of placement within the EAs. The present invention thus allows many users to escape a building simultaneously.

Additional advantages and novel features of the invention are set forth in the attachments to this summary, and in part will become more apparent to those skilled in the art upon examination of the following or upon learning by practice of the invention.

DETAILED DESCRIPTION

The present invention allows the escape of multiple persons from a multistory building, including allowing escape of a large number of persons over a short period of time, using strategically configured anchor points and components, and escape kits and devices. An embodiment of the present invention includes consideration of architectural features and design characteristics of each individual building in conjunction with features and variations in anchor points and components and use of escape kits and devices, so as to prevent or greatly reduce the likelihood of collision of people with one another or with interfering building features when escaping the building at or nearly at the same time. The considered architectural features and design characteristics include the building's external features and possible exit routes. The considered aspects of anchor points and components, along with escape kits and devices, include three dimensional design and placement of the anchor points and components with the determined EA features, so as to account for possibly interfering features, such as flagpoles, gargoyles, ledges, and statues.

In addition, the method and system of the present invention includes accounting for and incorporation of planning for all or as many as possible of the stories of each building, and all of the people inside or typically found in the building at the time of emergency escape. An embodiment of the present invention addresses problems with a large number of people escaping at or nearly at the same time, by using three dimensional features of the building and other features of the present invention, so as to allow escapees to travel along different, generally parallel paths, or along the same path, but coordinated so as to reduce the likelihood of collision or other interference among escapees.

An embodiment of the present invention includes planning for, placement of components, and use of kits and other devices, based on building configuration and features to allow efficient evacuation of the building. In an embodiment of the present invention, each individually operated escape kit or device is used with one of a plurality of anchor devices for the building, so as to allow the escaping user to rappel in a safe manner to the ground.

Figure 1:
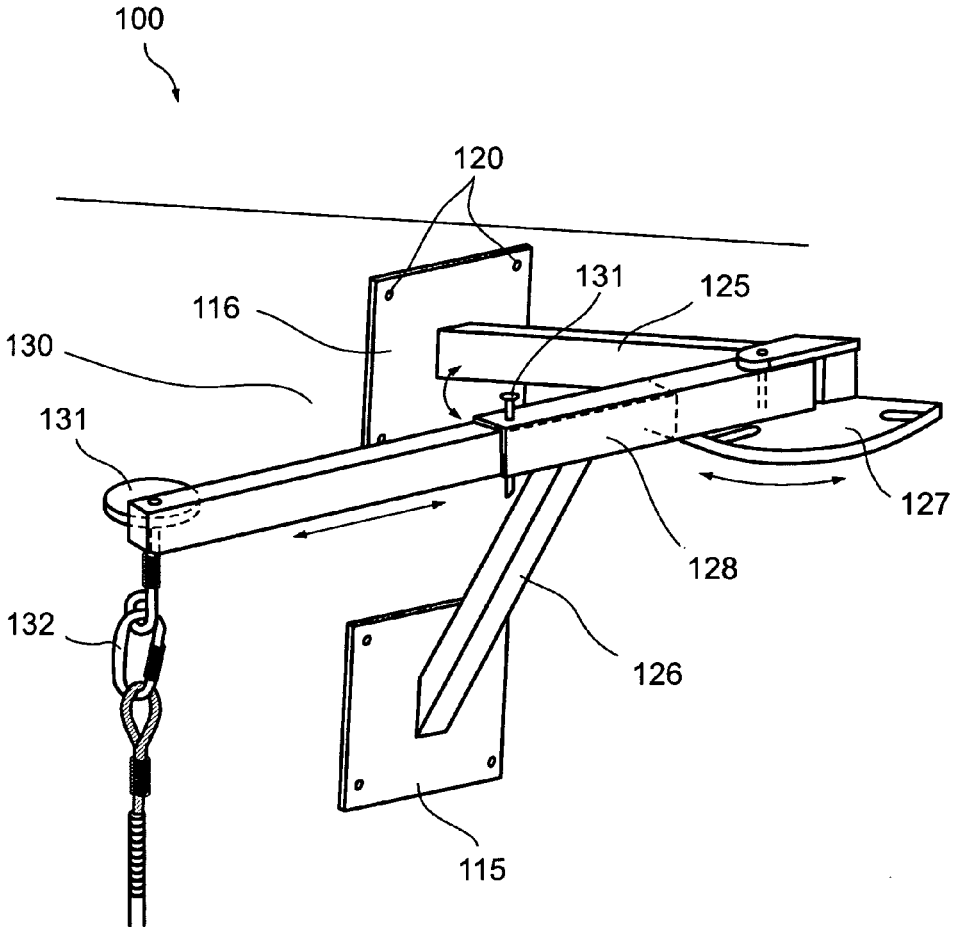
FIG. 1 illustrates an example anchor device for use in conjunction with embodiments of the present invention.

FIG. 1 illustrates an example anchor device for use in accordance with embodiments of the present invention. As shown in FIG. 1, the anchor device 100 includes one or more anchor feet 115, such as plates; one or more feet attachment devices 120, such as screws, nails, or nuts and bolts; a fixed extension arm 125; a support arm 126; a pivot support 127; a pivotable first extension arm 128; an extendable second extension arm 130, with connector 131 for connecting the pivotable first extension arm 128 and the extendable second extension arm 130; escape kit or extension attachment point 131; and attachment mechanism 132 for attaching the escape kit.

Figure 2:
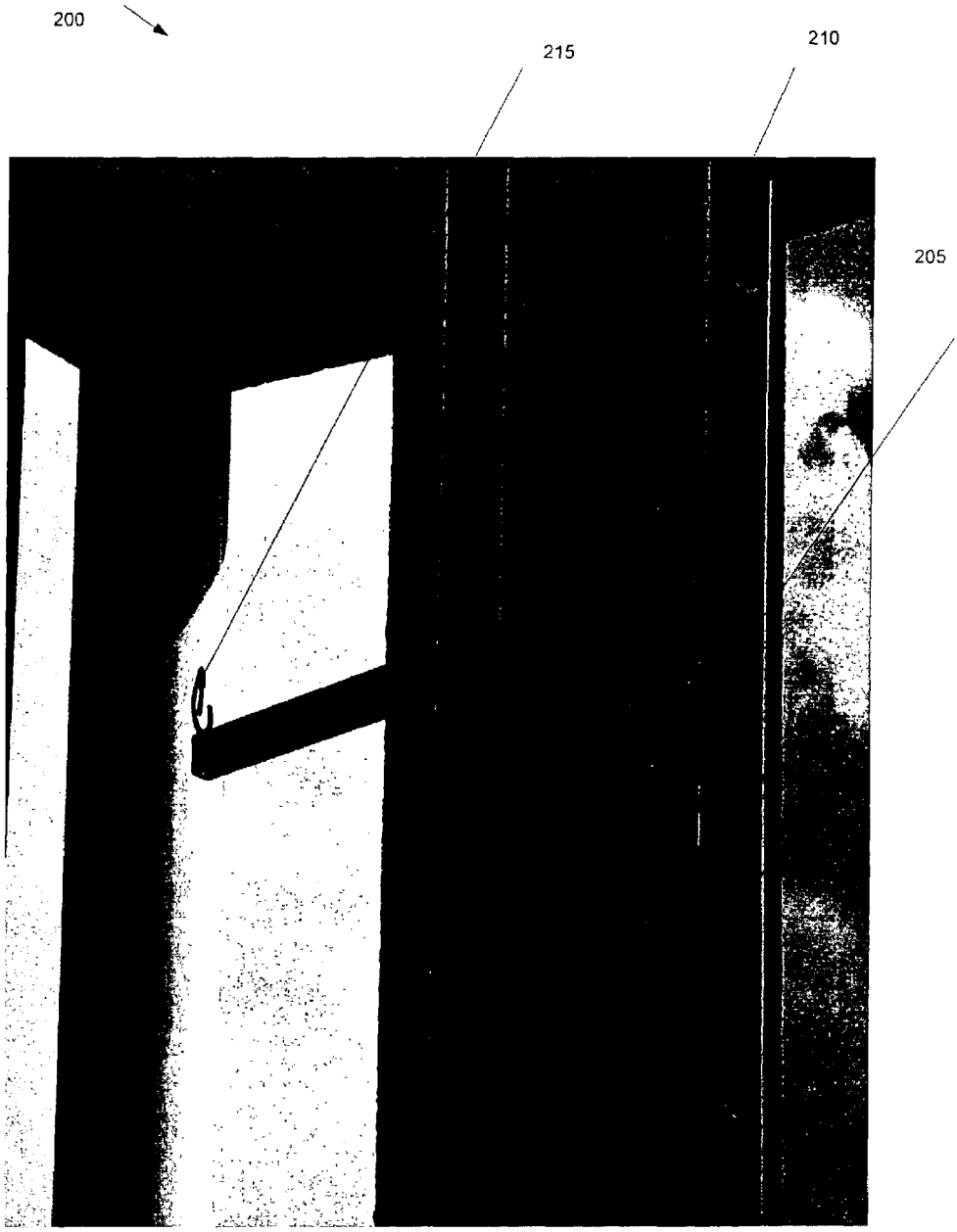
FIGS. 2–5 illustrate another example anchor device for use in accordance with embodiments of the present invention.
Figure 3:
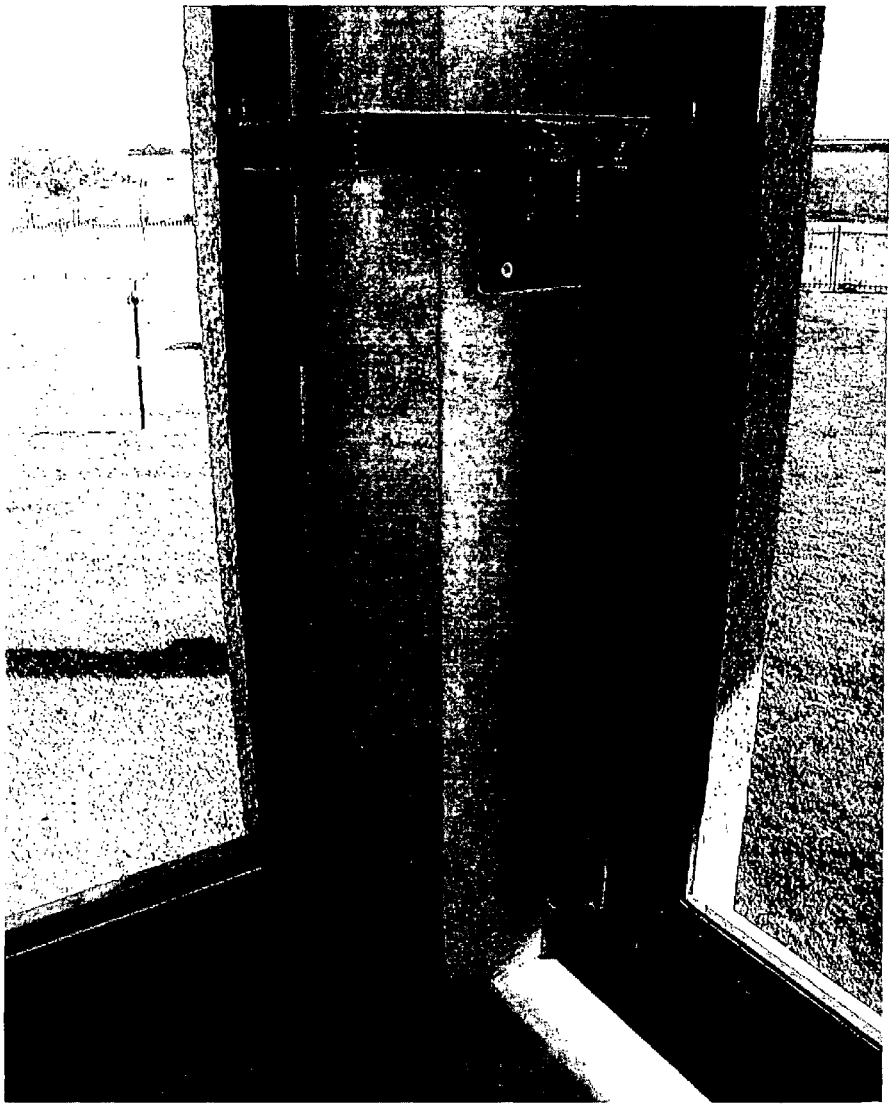
Figure 4:
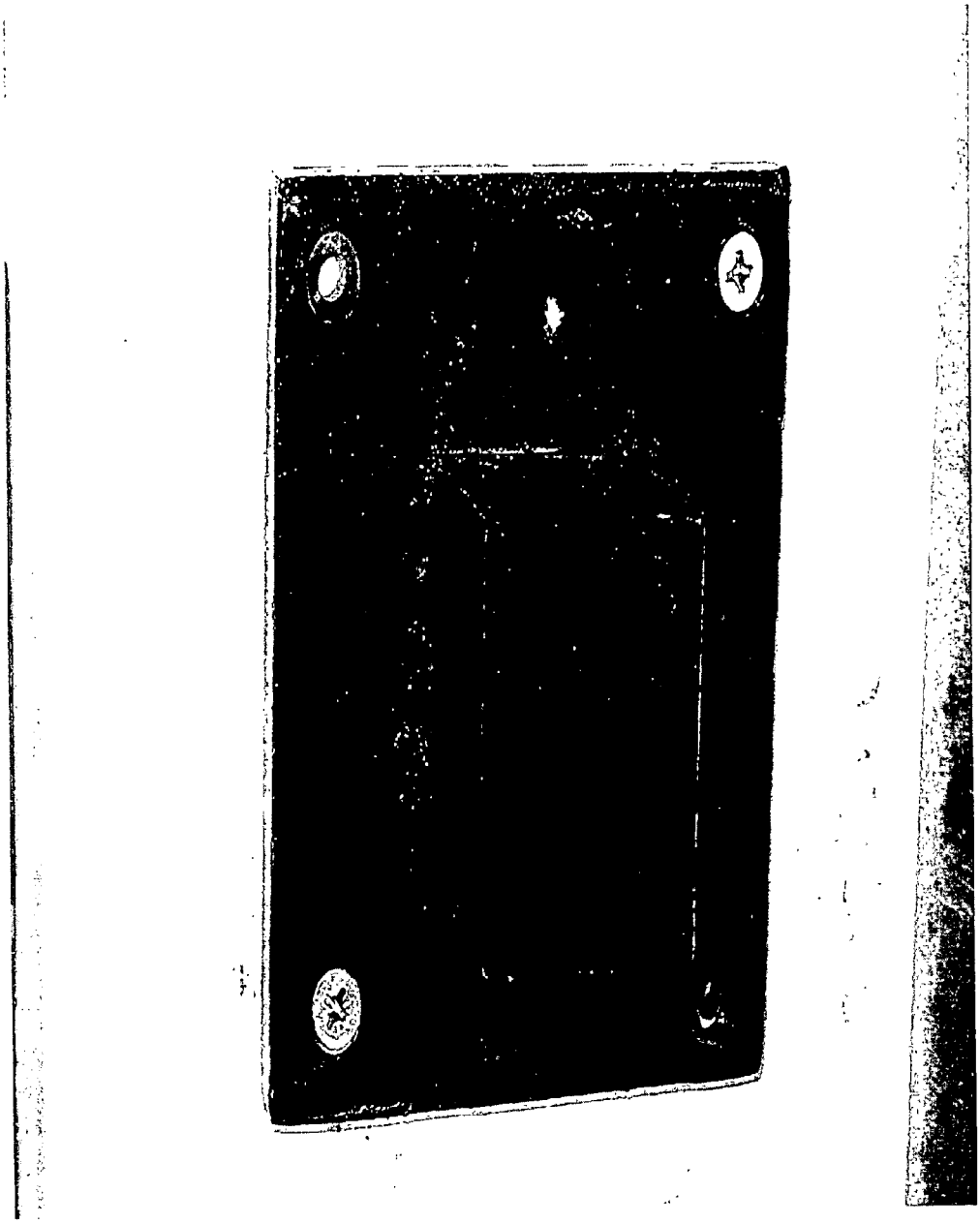
Figure 5:
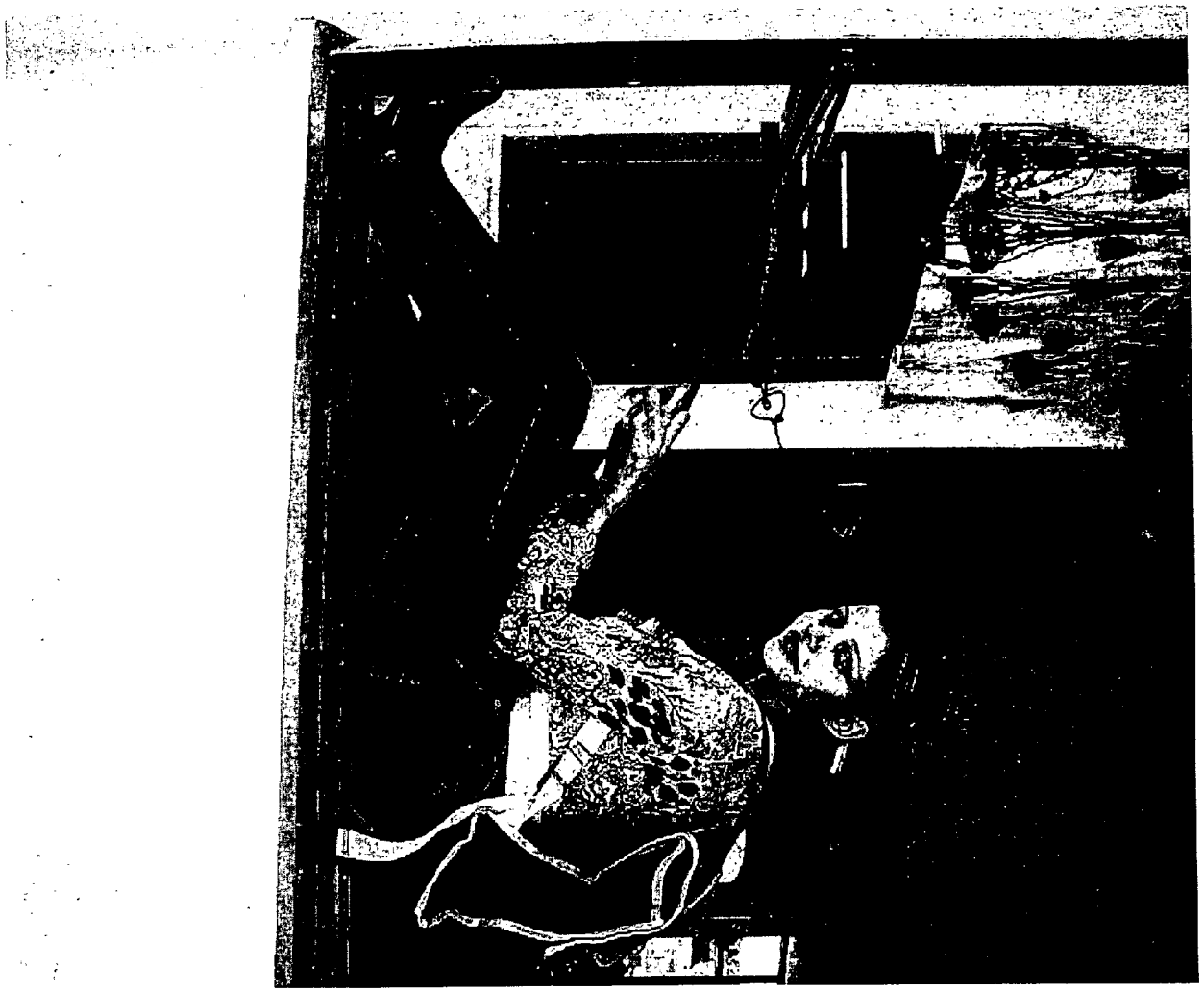

FIGS. 2–5 illustrate another example anchor device for use in accordance with embodiments of the present invention. As shown in FIG. 2, the anchor device 200 includes one or more anchor feet 205, such as plates, attached with one or more feet attachment devices, such as screws, nails, or nuts and bolts; a detachable extension and support arm 210; and an escape kit or extension attachment mechanism 215 for attaching the escape kit. FIGS. 3–5 illustrate other embodiments of the example anchor device 200.

In use, each anchor device, such as the example device 100, is strategically placed to allow efficient evacuation of a multistory building. An escaping user descends from the anchor device using an escape kit or device, which allows, for example, the user to rappel in a controlled manner to the ground. The anchor device is preferably unobtrusive and permanently fixed to the face of the building.

As will be described further below, embodiments of the present invention include anchor devices that allow escaping users to rappel along parallel paths simultaneously or nearly simultaneously from multiple anchor devices located above and below one another. For example, for the anchor device 100 shown in FIG. 1, users are able to attach escape kits or devices and use the anchor device 100 in several positions. In a first position, as shown in FIG. 1, the pivotable first extension arm 128 and the extendable second extension arm 130 are perpendicularly held relative to the fixed extension arm 125, via the pivot support 127. A user, for example, attaches an escape kit or device to the attachment mechanism 132 from a nearby window or other exit, and descends with the anchor device 100 in the position shown in FIG. 1.

In a second position, the user descends from the anchor device 100 using an escape kit or device attached to the attachment mechanism 132 with the pivotable first extension arm 128 and the extendable second extension arm 130 pivoted via the pivot support 127 so as to be aligned (colinear) with the fixed extension arm 125. If, for example, a first anchor device 100 in the first position is located above a second anchor device in the second position, users of both devices may descend using escape kits or devices along parallel paths without interfering with one another.

In a third position of the anchor device 100, the first extension arm 128 and the extendable second extension arm 130 are pivoted so as to be aligned with the fixed extension arm 125, as in the second position, and the extendable second extension arm 130 is either further extended or less extended, relative to the first extension arm. Thus, similar to simultaneous use of the first position and the second position for anchor devices located above and below one another, users may use the anchor device 100 in the third position while users use anchor devices in the first or second positions located above or below the anchor device 100 in the third position.

Figure 6:
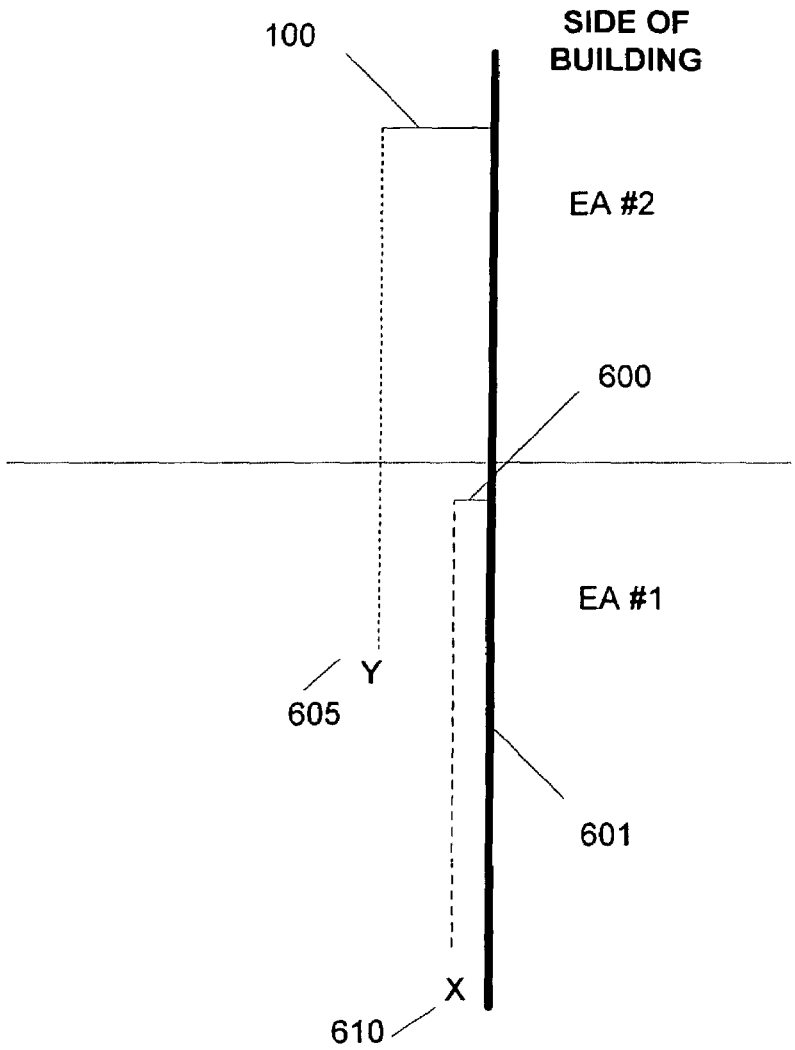
FIG. 6 illustrates an example use of a method and system of escape relative to an outer wall of a representative building, in accordance with embodiments of the present invention.

FIG. 6 presents a view perpendicular to the plane of a building face 601, showing a first anchor device 100 in the second position located above a second anchor device 600 in the third position, in accordance with embodiments of the present invention. In the example shown in FIG. 6, the second position of the first anchor device 100 is at greater extension relative to the building face 601 than the third position of the second anchor device 600. Thus, as shown in FIG. 6, a first escaping user 605 descending from the first anchor device 100 is able to descend simultaneously with a second escaping user 610 descending from the second anchor device 600. As shown, the first escaping user 605 and the second escaping user 610 descend along two parallel, but not interfering, paths, even though, in this example, the first anchor device 100 is located immediately above the second anchor device 600.

Note that embodiments of the present invention are not limited to external placement of anchors, but optionally include some or all anchor placement within the building. For example, anchors may be placed on a wall inside the building adjacent to a window for rappeling out the window from inside the building.

In embodiments of the present invention, each escape kit or device includes various components for rappelling or otherwise allowing the user to descend from the building in a controller manner. In an embodiment of the present invention, the components of the escape kit or device include a rope or cable, a harness device, a braking device, and a connector for connecting the escape kit or device to the anchor device. In an embodiment of the present invention, at least one escape kit or device is provided for each possibly escaping user, and each kit or device is so designed that little or no prior knowledge or practice is required of the escaping user in order to be used properly.

Figure 7:
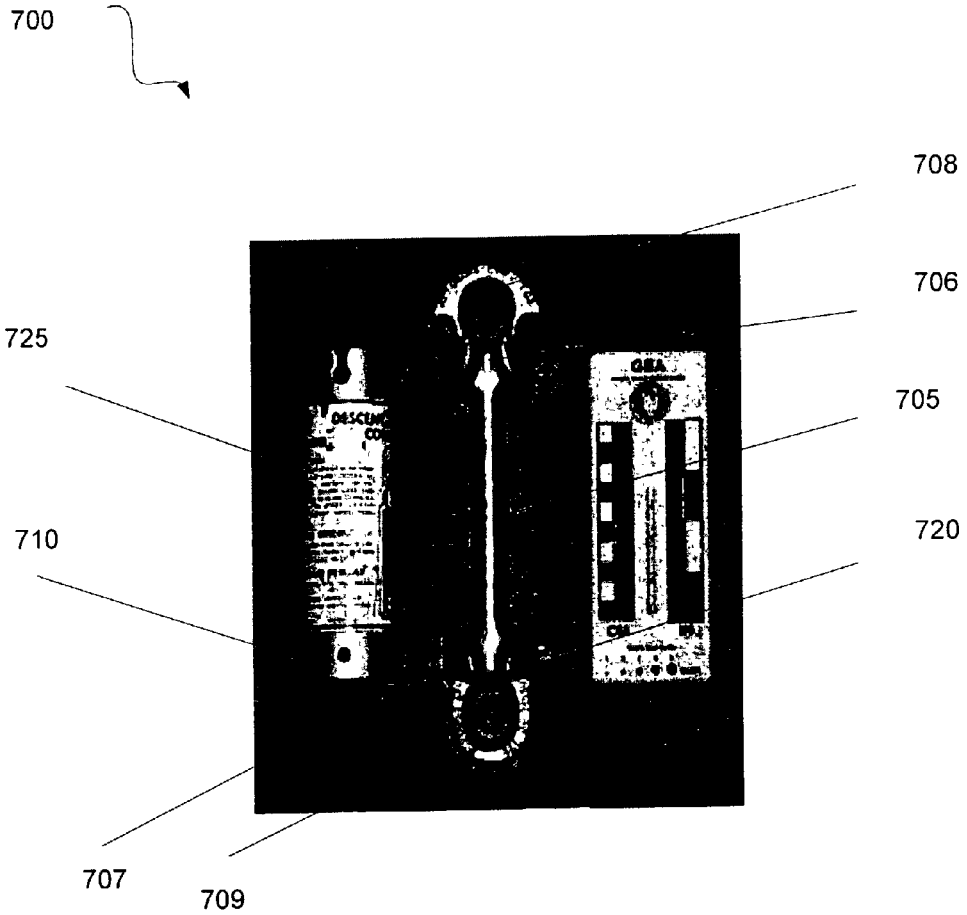
FIGS. 7 and 8 present an example kit for use in conjunction with embodiments of the present invention.
Figure 8:
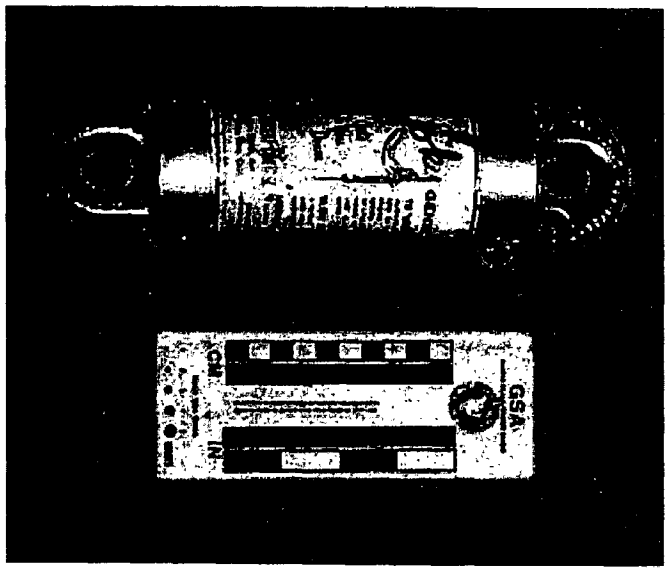
Figure 9:
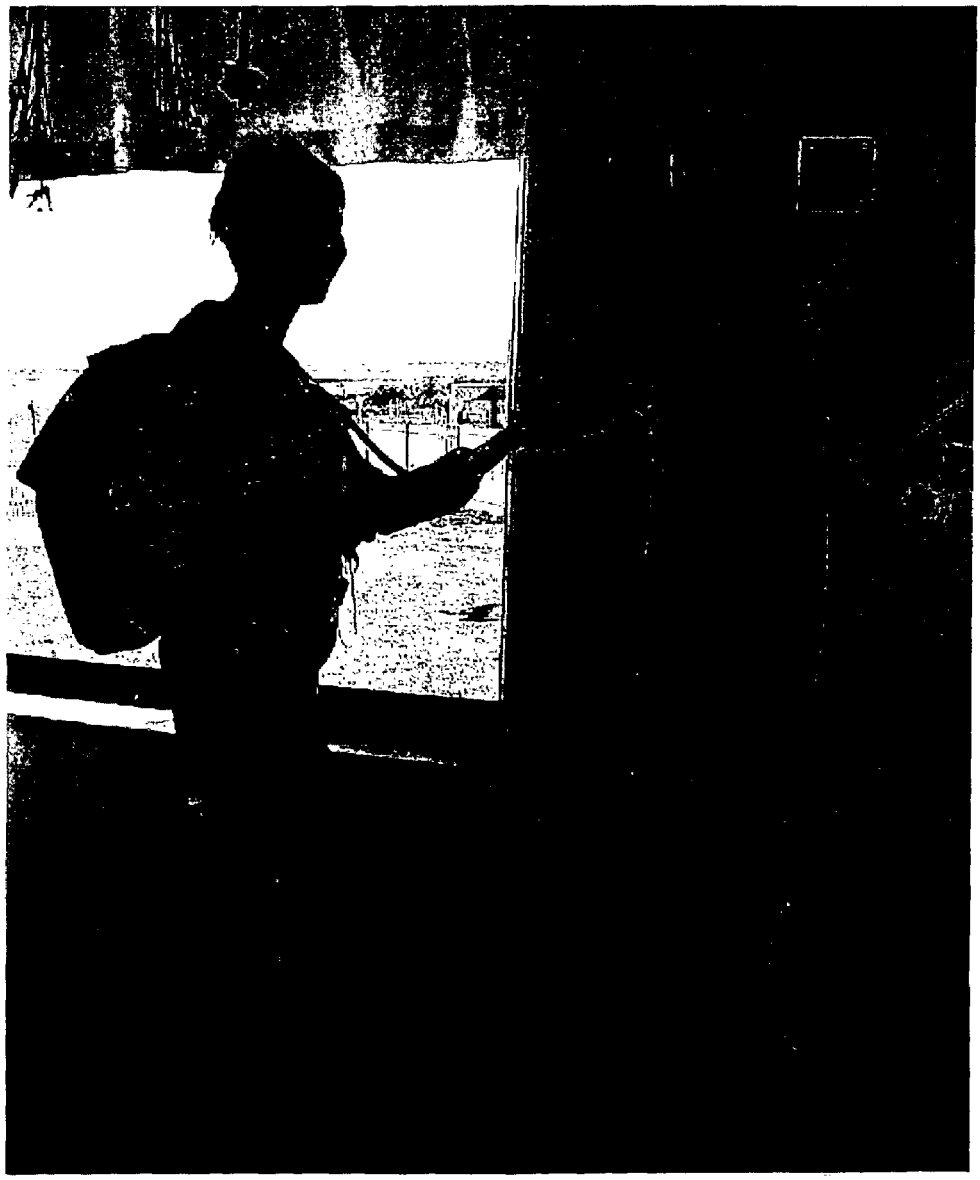
FIGS. 9–13 illustrate another example kit for use in conjunction with embodiments of the present invention.
Figure 10:
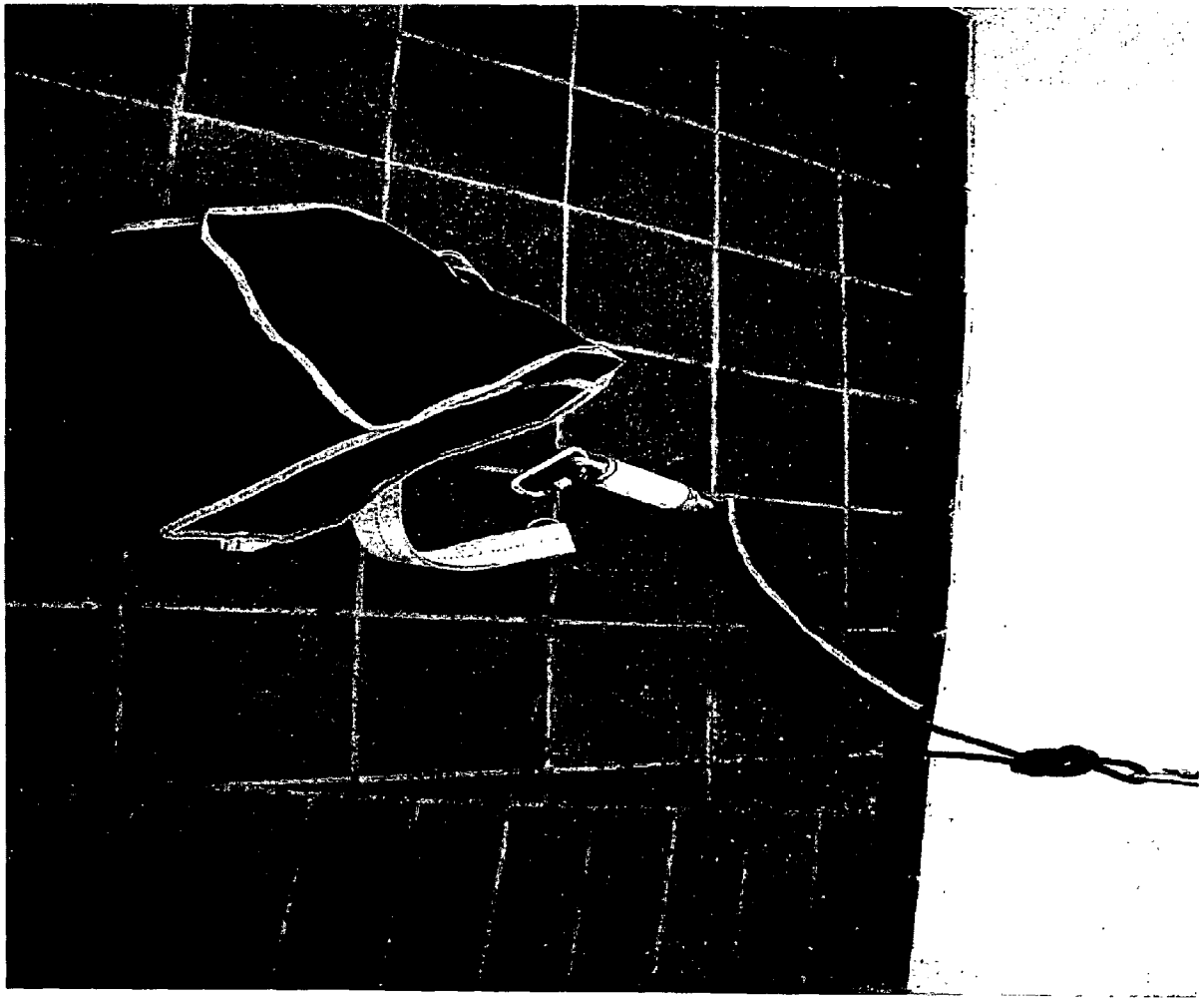
Figure 11:
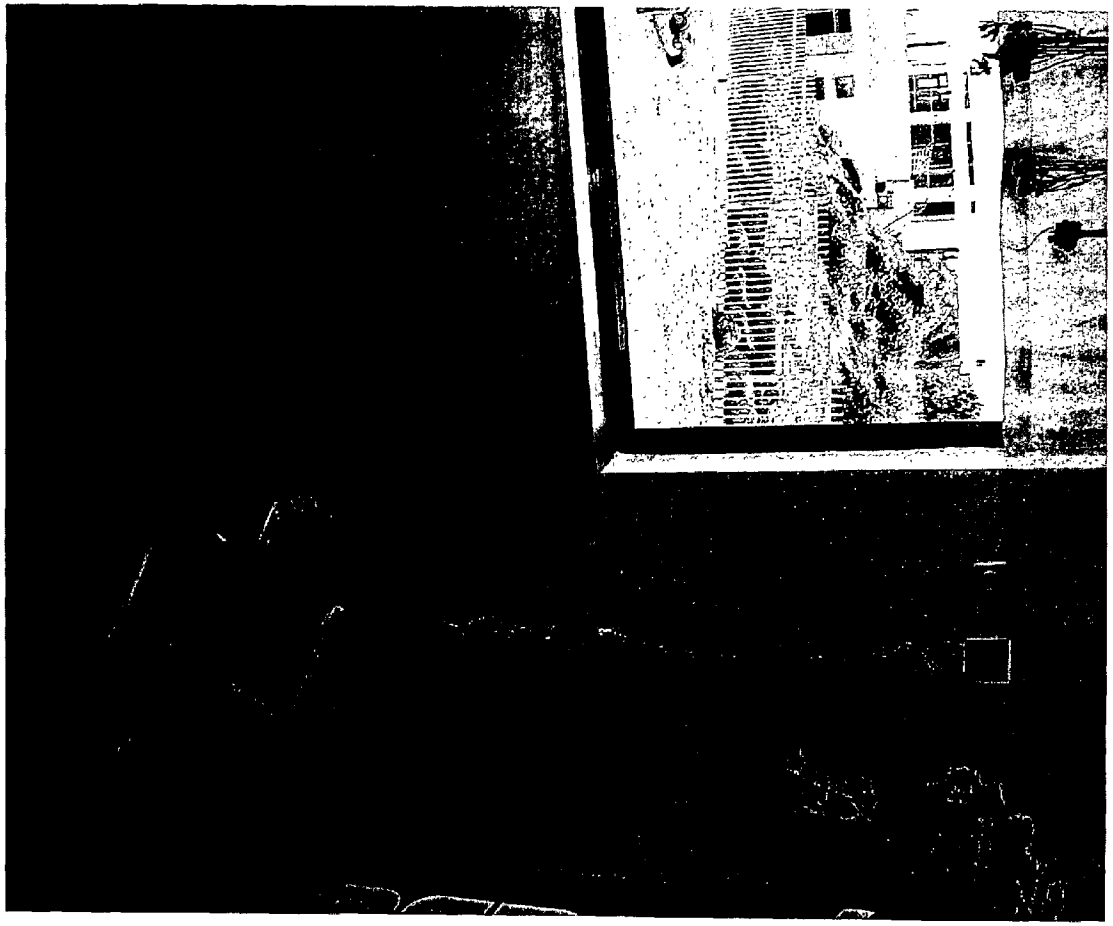
Figure 12:
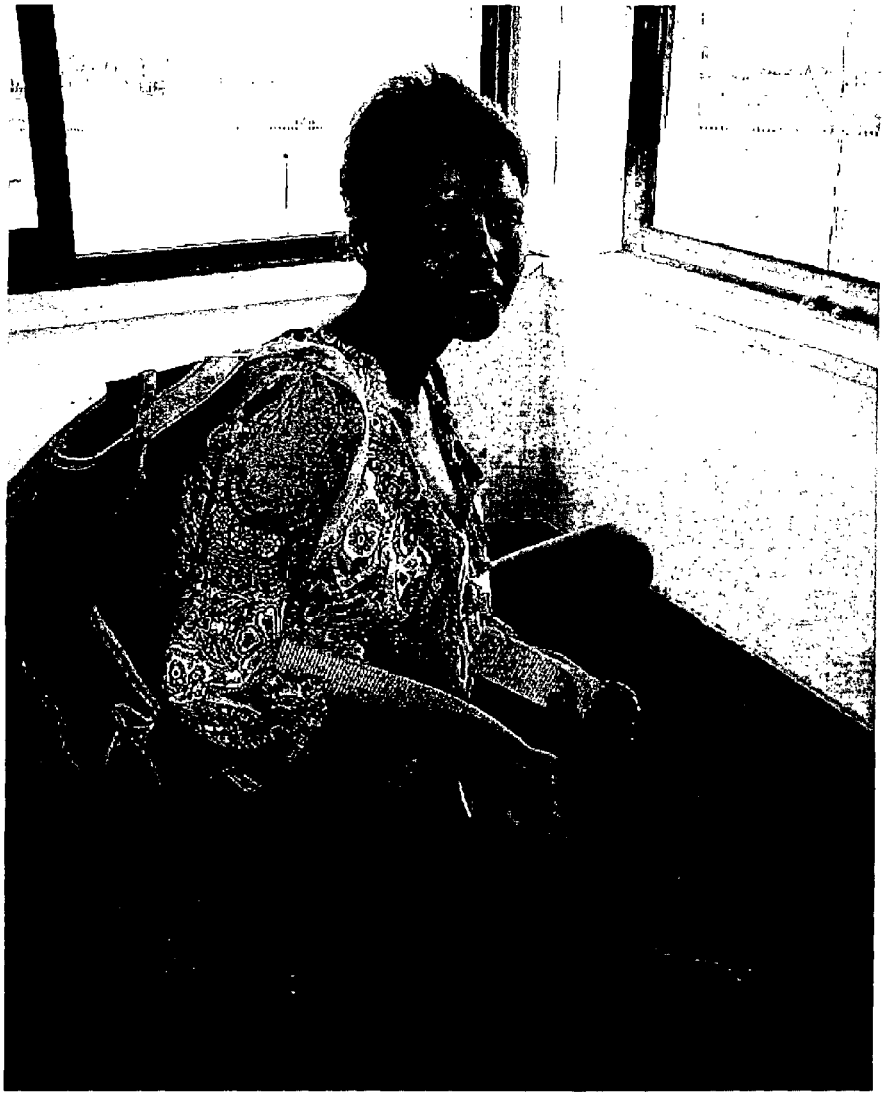
Figure 13:
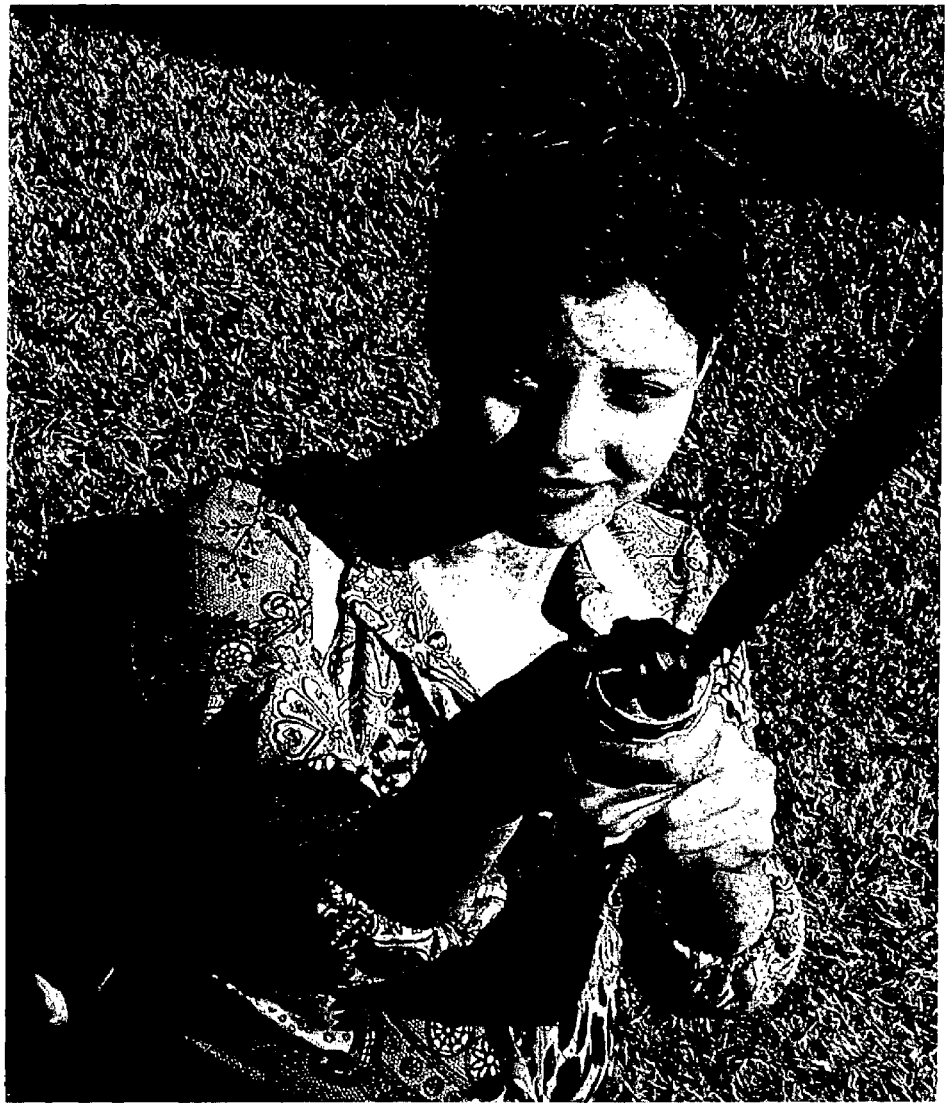

FIGS. 7 and 8 illustrate portions of an example escape kit or device for use with an attachment anchor or device in accordance with embodiments of the present invention. FIG. 7 presents portions of an example kit 700 in assembled form. FIG. 8 illustrates the portions of the example kit 700 of FIG. 7 in disassembled form. In the embodiment shown in FIGS. 7 and 8, the kit, such as the Sky Genie™ made by Descent Control, Inc., of Fort Smith, Ark., or other similar kits as are known in the art, includes a shank portion 705, with rope guides 706, 707 and attachment openings at each end 708, 709 of the shank portion 705, a cover 710, cover securing features, such as a bolt with a knurled knob 715, to secure the cover at the top, as shown in FIG. 8, and a pin 720, to secure the cover at the bottom, as shown in FIG. 8. In this example embodiment, instructions for use 725 are printed on the cover 710.

The portions of the example kit 700, as shown in FIGS. 7 and 8 are used, for example, with a rope or cable to control descent of a user by controlling the speed the rope or cable passes through the portions of the example kit 700. The portions of the example kit 700 are rigged with the rope or portion by removing the cover 710, wrapping the rope or cable about the shank portion an appropriate number of times to control speed of descent for the weight of the user, and feeding the rope or cable through both rope guides 706, 707 and both attachment openings 708, 709. The cover 710 is then placed on the device.

The portions of the example escape kit shown in FIGS. 7 and 8 are used in conjunction with, for example, the rope or cable, as described, and the rope or cable is attached to an anchor device. For use in an escape, for example, a self contained complete kit that includes the components shown in FIGS. 7 and 8, a rope or cable passing through the assembled components shown in FIGS. 7 and 8 so as to allow controlled frictional or other passage of the rope or cable through the components shown in FIGS. 7 and 8, and a harness attached to one end of the components shown in FIGS. 7 and 8 are used. The harness is attached to the user and one end of the portions of the kit shown in FIGS. 7 and 8, and a free end of the rope or cable is attached to the anchor device. The user then exits the building, such as from a floor well above the ground, and the rope or cable passing in a controlled manner through the components shown in FIGS. 7 and 8 allows the user to descend in a controlled manner from the exit.

In an embodiment of the present invention, a self-contained complete kit is maintained in the building for each potential escaping user in an emergency. For example a complete kit may be kept at the desk or in the office of each user, or a set of complete kits may be kept near each exit.

FIGS. 9–13 illustrate portions of another example escape kit or device for use with an attachment anchor or device in accordance with embodiments of the present invention.

Figure 14:
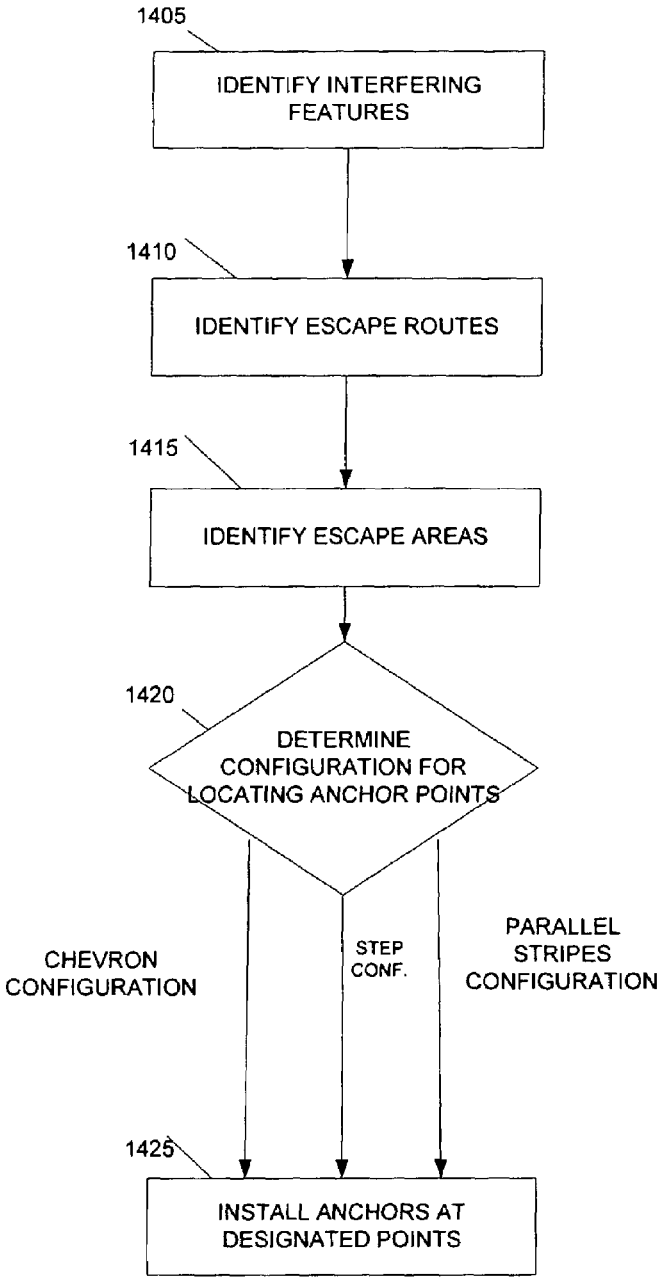
FIG. 14 provides a flow diagram of a method of escaping from a multistory building, in accordance with embodiments of the present invention.

FIG. 14 illustrates an overview of a method for providing escape from a building, in accordance with an embodiment of the present invention. The method generally includes the following: 1) identifying any interfering features on the building from which escape is planned; 2) identifying possible exits for use for escape from the building, with the possible exits being identified in one embodiment of the present invention based on the planning for or around the presence of interfering features; 3) identifying possible EAs based on the identified exits; 4) determining an escape device configuration; and 5) emplacing escape devices according to the determined configuration. The method is followed for each face or other appropriate portion of the building. For buildings with a round, curved, or otherwise irregular face, EAs are defined about the face of the building.

As shown in FIG. 14, any interfering features are identified 1405. The interfering features include, for example, protrusions, statues, and other objects or pieces of the building, which, from their positioning relative to a possible escape route, make it difficult or impossible to safely descend to the ground using an exit.

The exits are identified 1410. For example, for some building, each window defines an exit. However, for example, if a window has an interfering feature below it, that window is not defined as an exit, since that feature could interfere with escape.

The EAs are identified 1415, such as based on the number of exits and the building characteristics. In accordance with one embodiment of the present invention, each EA, is defined as having a width ($W_{EA}$) and a height ($H_{EA}$). For example, an EA may correspond to a portion of one face of a building, the EA having a width equal to the width of the face, and a height corresponding to a portion of the height of the building. In one embodiment of the present invention, the height of each EA on a face equals the sum of the heights of the number of floors corresponding to twice the number of the exits included in the EA ($H_{EA}$=2×exits). Thus, for example, if there are eight windows for each floor along the face of the building, and no interfering features are located below the windows, the EA has a width equal to building width and a height equal to 16 floors.

In an example in accordance with one embodiment of the present invention, for buildings for which more than one EA is appropriate for the building, such as more than one EA for each face, each EA is defined successively from the lowest to the highest floors of the building. For example, a first EA, referred to in this example as "EA #1," is identified from a lowest applicable floor for escape up to a top floor included in EA #1, with a width equal to the width of the face and a height equal to twice the number of exits included in the EA ($H_{EA}$=2×exits). The width of the remaining EAs is identified as having the same width as EA #1 ($W_{EA}$=building face width). The height of the remaining EAs are defined as having either the same height as EA #1 ($H_{EA}$=2×exits), or, if there are not enough floors to constitute the same height as EA #1, the remaining number of floors in the building. Thus, for example, if there are 45 floors in a building with eight exits on a building face, EA #1 would have a width of eight exits, and a height of 16 floors.

EA #2 would have a width of eight exits, and a height of 16 floors. EA #3 would have a width of eight exits, and a height of 13 floors (the number of remaining floors).

In one embodiment, for a circular building, at least one EA is defined as part of the building. In this embodiment, the chevron configuration or parallel stripes configuration may be used to place the anchors. In an alternative embodiment, for the circular building, the EA is defined as the entire building. In this embodiment, the step configuration, described below, may be used to place the anchors.

An anchor configuration is then determined 520. A wide variety of anchor configurations are usable in accordance with the present invention, the configurations being variable based on, among other factors, three dimensional parallel use of escape kits or devices with anchors and building configuration and features. Three illustrative examples of anchor configurations, in accordance with an embodiment of the present invention, will now be described. These illustrative examples, referred to as a "chevron configuration", a "parallel stripes configuration," and a "step configuration" are as follows.

Figure 15:
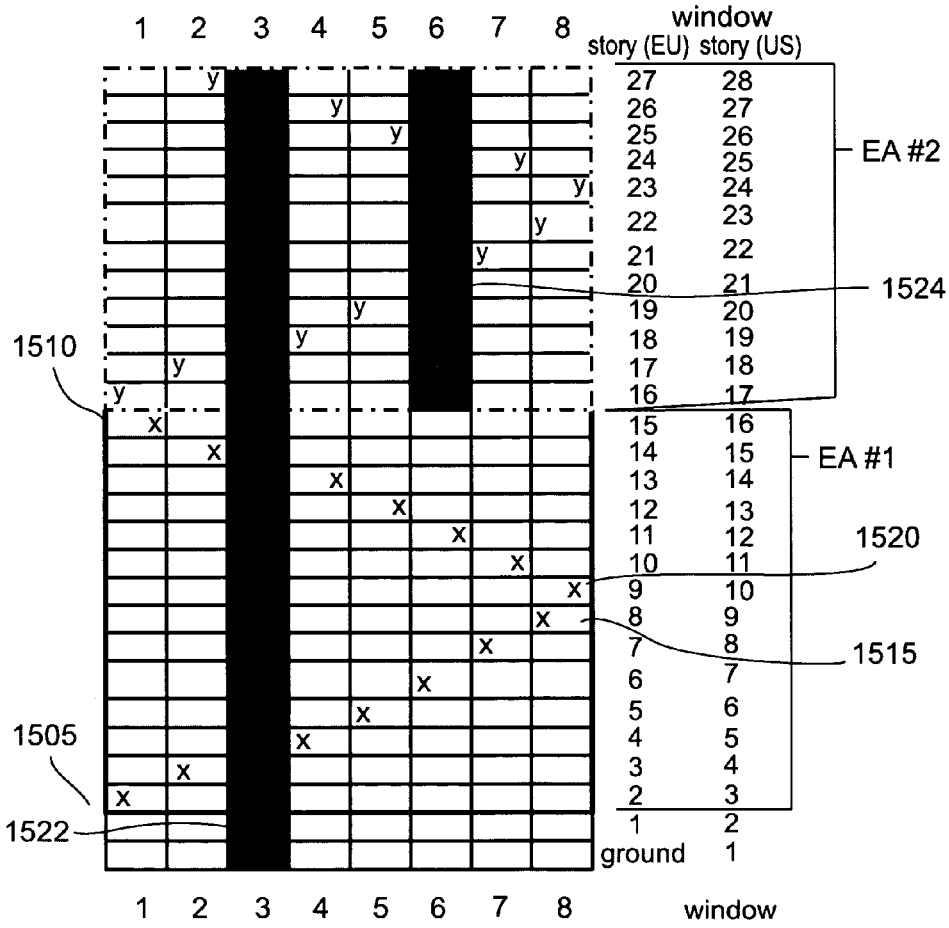
FIGS. 15–16 show an example use of a method and system for escape from a representative building having a rectangular or square footprint and a rectangular or square profile, using the chevron configuration, in accordance with embodiments of the present invention.

Chevron configuration. The chevron configuration includes a pattern of two diagonal lines of anchor points meeting at an angle. FIG. 15 presents an example of a chevron configuration in accordance with an embodiment of the present invention. FIG. 15 presents a single building face for a building, the building face including eight columns containing windows or other exits (the columns include the escape route portion below each window), and 28 U.S. floors (27 European defined floors). In the example shown in FIG. 15, there is a statue 1522 at the ground story of column 3, and a protrusion 1524 at the sixteenth story of column 6. As shown in FIG. 15, the chevron configuration occurs, for example, by the pattern of Xs and Ys, which represent locations of anchor devices. For example, in FIG. 15, a first chevron portion is defined by bottom diagonal line portion 1505 of the chevron, the anchors X being set on one side of a window or other exit (e.g., the left side of each exit area, as shown in FIG. 15). In a top diagonal line portion 1510 of the chevron, the anchors X are set on the opposite side of the window or other exit (e.g., the right side of each exit area, as shown in FIG. 15). As also shown in the example of FIG. 15, the third column of exits (e.g., windows) is not usable with EA #1 due to the presence of the interfering feature of the building.

The chevron configuration is similarly repeated on the subsequent EA, located above the first EA (the next EA being referred to in this example as "EA #2"), as shown in FIG. 15. EA #2 comprises U.S. stories 16–27, with the anchors Y continuing for each remaining floor. As shown in the example of FIG. 15, the third column of exits is not usable with EA #2 due to the presence of the interfering feature of the building in EA #1, and the sixth column of exits is not usable with EA #2 due to the presence of the interfering feature of the building in EA #2.

As also shown in FIG. 15, the chevron pattern used in this example allows descent by escaping users from multiple EAs along a column of windows without interference. For example, in exit column 4 of EA #1, the anchor is located on the left side of the exit on the fifth floor (U.S.), while the anchor is located on the right side of the exit on the fourteenth floor (U.S.). Thus, descending users can exit from both the fifth and the fourteenth floors simultaneously without interfering with one another. In addition, if the fifth and fourteenth floor (U.S.) anchors are each configured such that descending users descend from an anchor extension point that is closer to the building face (see, e.g., anchor device 600 shown in FIG. 6) than the anchors for the nineteenth and twenty-seventh floors (U.S.) (see, e.g., anchor device 100 shown in FIG. 6), escaping users may exit from the fifth, fourteenth, nineteenth, and twenty-seventh floors simultaneously without interfering with one another.

Figure 16:
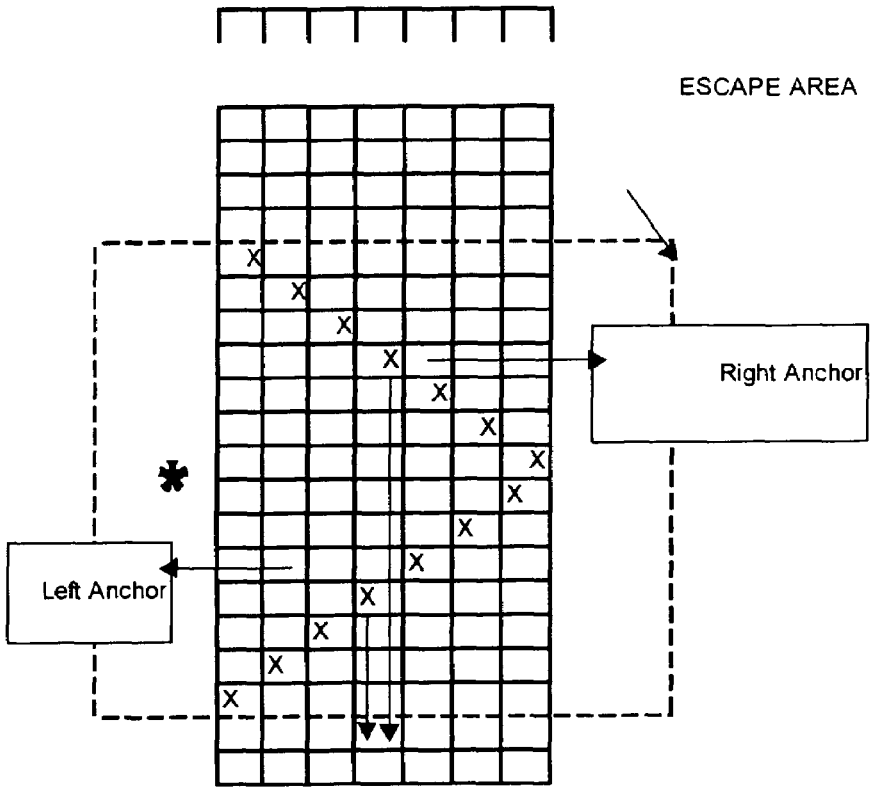

FIG. 16 presents another view of the chevron configuration in accordance with embodiments of the present invention.

Figure 17:
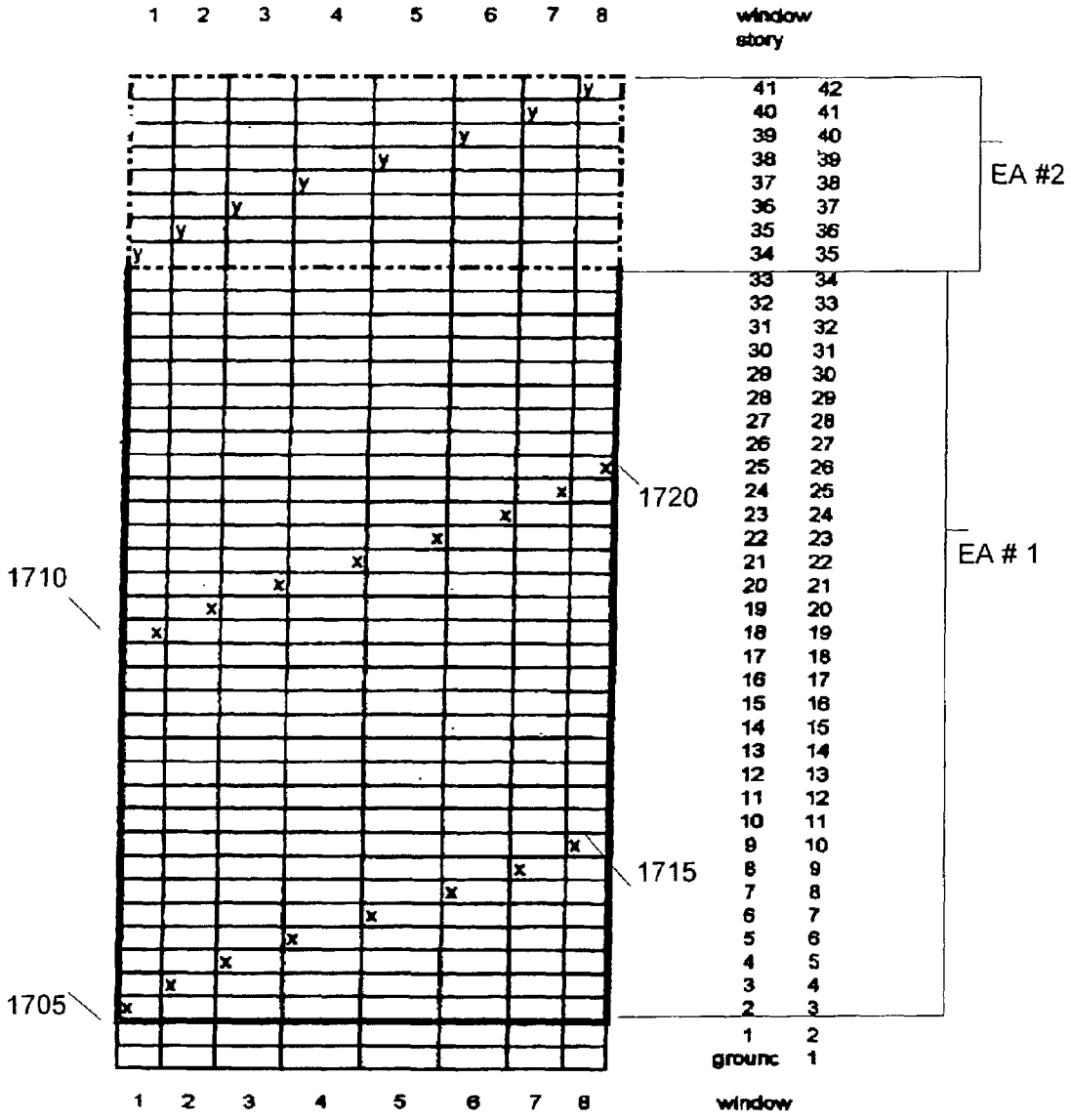
FIGS. 17–18 contain an example use of a method and system of escape from a representative building having a circular footprint, using the parallel stripes configuration, in accordance with embodiments of the present invention.

Parallel stripes configuration. The parallel stripes configuration involves a pattern of parallel lines of anchors encompassing the building. An example of the parallel stripes configuration is shown by the pattern of Xs and Ys viewed from one side of a circular footprint building, as shown in FIG. 17. Referring to FIG. 17, the first EA, referred to in this example as EA #1, includes an angled row of anchors extending along a "face" or portion of the building, defined as EA#1 (note that the anchors encircle the building in three dimensions; portions of the building are not visible in FIG. 17), with two anchors for each column of exits. As shown in the view of the building in FIG. 17, two portions 1705, 1710 of the continuous angled line of anchors are visible. EA #1 includes a first, bottom portion of the angled line of anchors 1705, as shown in FIG. 17, with the anchors X being set on one side of each window or other exit (the left side in the example shown in FIG. 17). In the second, top portion of the angled line of anchors 1710 of EA #1, the anchors X are set on the opposite side of each window or exit from the side for the first angled line of anchors 1705 (the right side in the example shown in FIG. 17).

Each anchor in a column of exits (e.g., anchor 1715 in column eight for the first portion of the line of anchors 1705) is thus on the opposite side of the exit from the subsequent anchor in the same column (e.g., anchor 1720 in the second portion of the line of anchors 1710). A similar parallel configuration of anchors is repeated for a "face" or portion of the building defined as EA #2, except that Ys are used to designate the anchors. Similarly to the relative positioning of anchors to one another and their extension distance relative to the curved face for the chevron configuration shown in FIG. 15, the anchors of the example shown in FIG. 17, are positioned relative to one another and relative to the curved building face (e.g., extended varying distances from the face) so as to allow multiple simultaneous building escapes along a column of exits.

Figure 18:
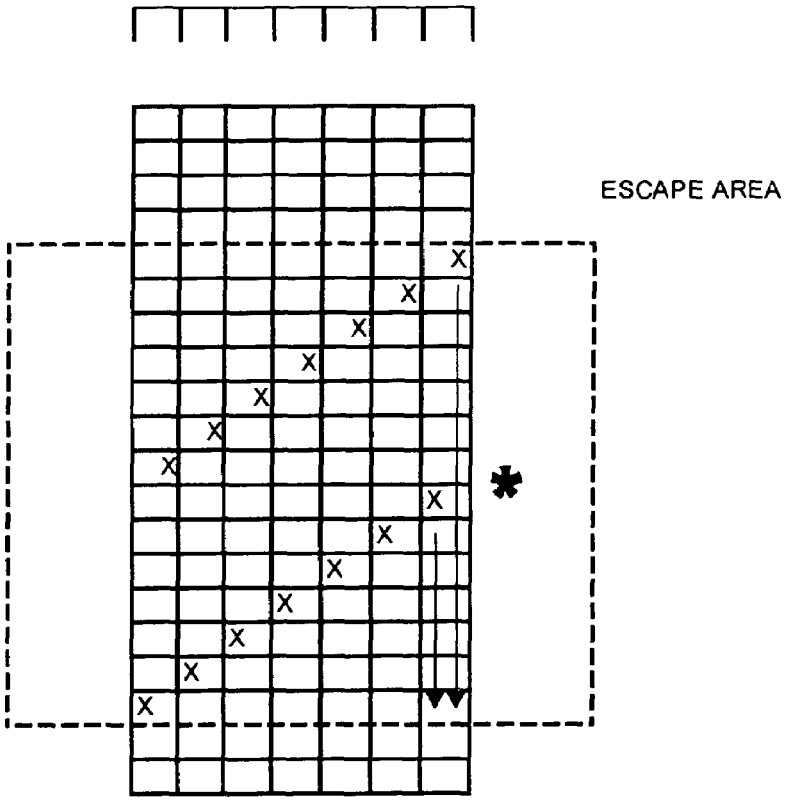

FIG. 18 presents a view of the parallel stripes configuration in accordance with another embodiment of the present invention.

Step configuration. The step configuration comprises a pattern of one step placed per floor, ascending in a stair-like pattern. An example of the step configuration is shown by the pattern of Xs in FIG. 19.

The step configuration is similar to the parallel stripes configuration, except the step configuration is used for circular buildings (as well as other building shapes) where the whole building is defined as one EA. In contrast, the parallel stripes configuration is used for circular buildings (as well as other building shapes) where the EA is defined as part of the building.

Figure 19:
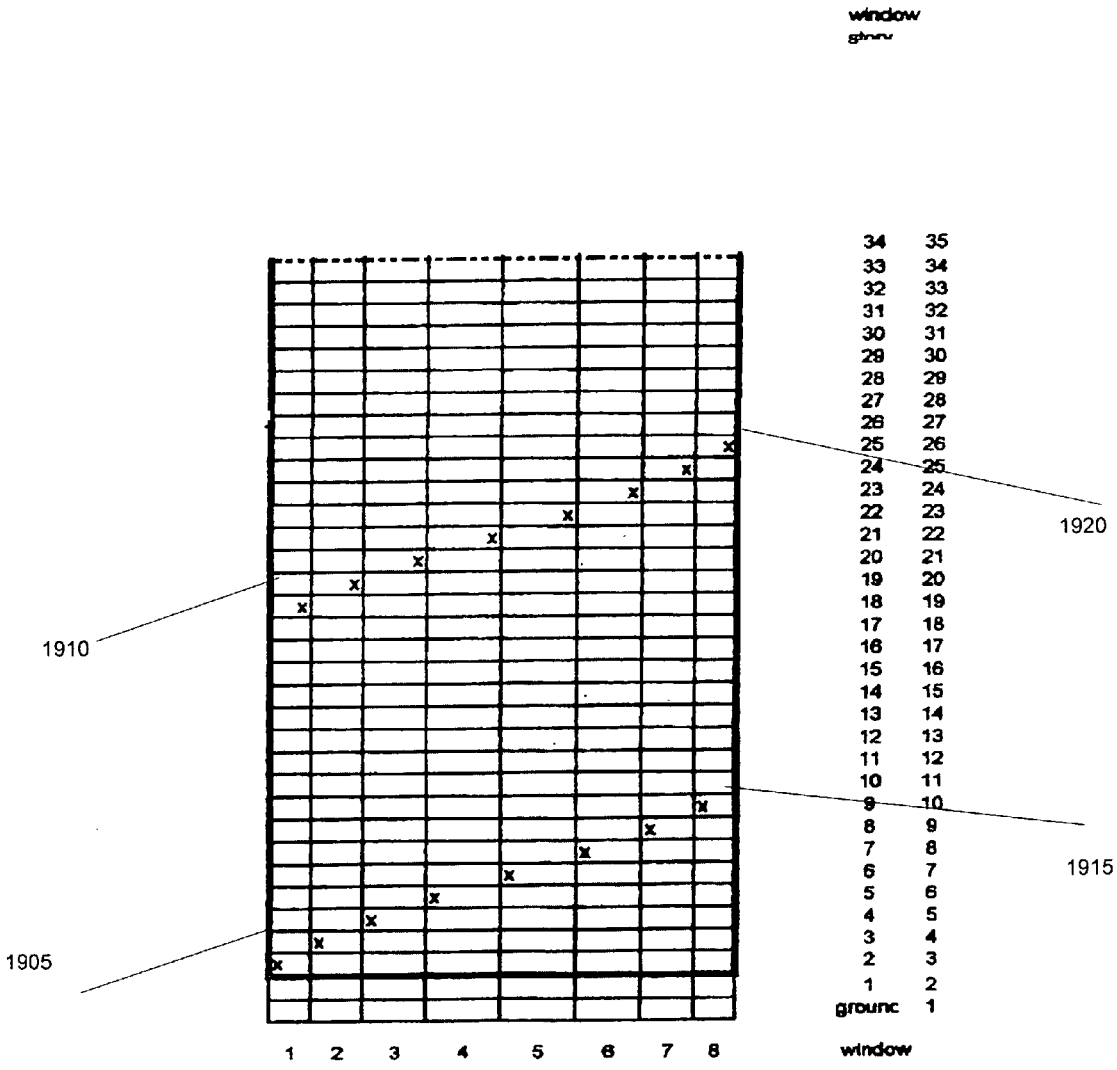
FIG. 19 contains an example use of a method and system of escape from a representative building having a circular footprint, using the step configuration, in accordance with embodiments of the present invention.

Referring to FIG. 19, EA #1 is defined as the entire circular building. The anchors X are set in a step pattern 1905 on one side (the left side in this example) of an exit (e.g, window) for each exit, going around the entire building, as shown in FIG. 19. Referring to FIG. 19, the first and only EA, referred to in this example as EA #1, includes an angled row of anchors extending about the entire building (note that the anchors encircle the building in three dimensions; portions of the building are not visible in FIG. 19), with two anchors for each column of exits. As shown in the view of the building in FIG. 19, two portions 1905, 1910 of the continuous angled line of anchors are visible. EA #1 includes a first, bottom portion of the angled line of anchors 1905, as shown in FIG. 19, with the anchors X being set on one side of each window or other exit (the left side in the example shown in FIG. 19). In the second, top portion of the angled line of anchors 1910 of EA #1, the anchors X are set on the opposite side of each window or exit from the side for the first angled line of anchors 1905 (the right side in the example shown in FIG. 19).

Each anchor in a column of exits (e.g., anchor 1915 in column eight for the first portion of the line of anchors 1905) is thus on the opposite side of the exit from the subsequent anchor in the same column (e.g., anchor 1920 in the second portion of the line of anchors 1910).

Figure 20:
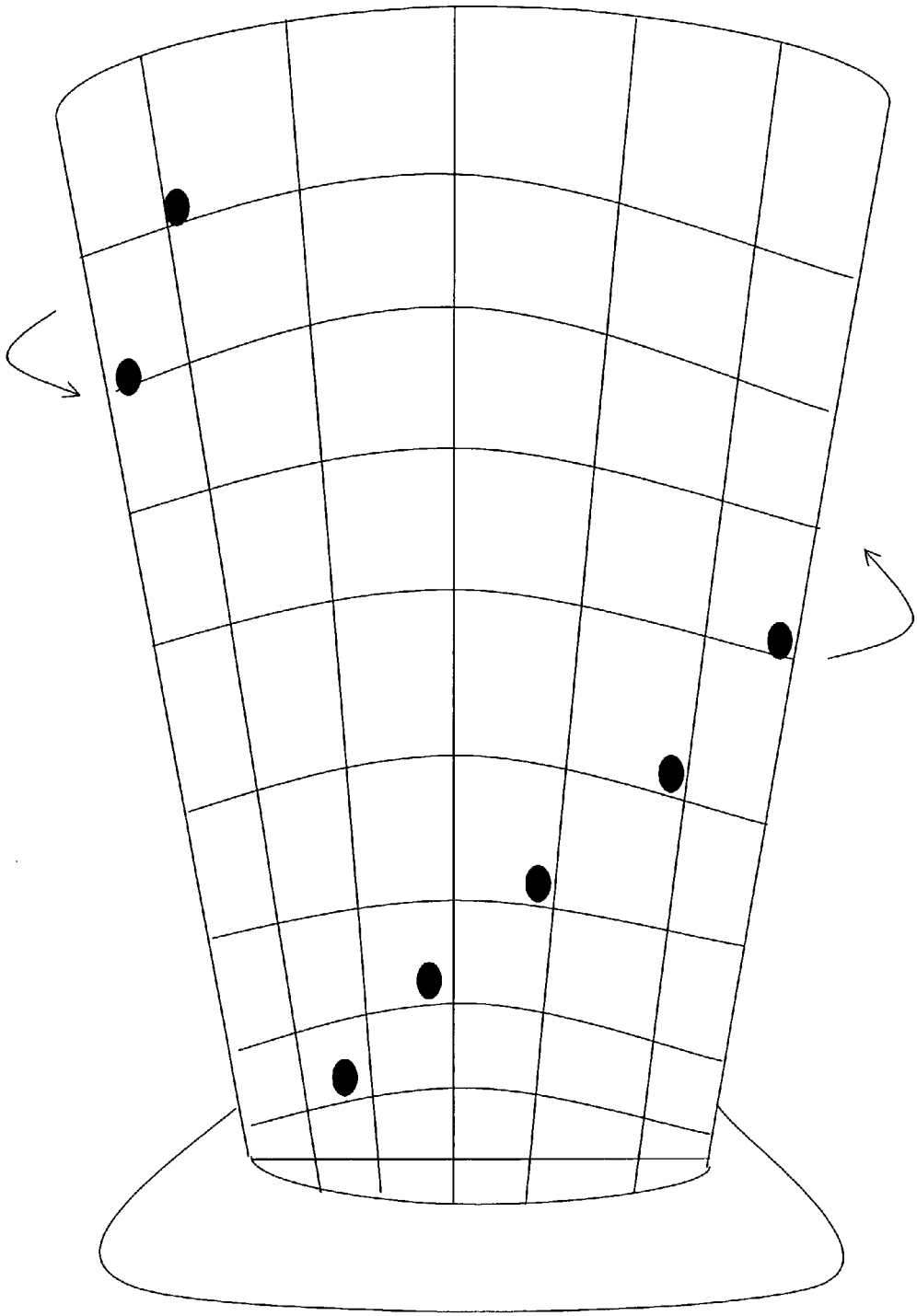
FIGS. 20–22 illustrate additional embodiments of the chevron configuration, the parallel stripes configuration, and the step configuration, in accordance with embodiments of the present invention.
Figure 21:
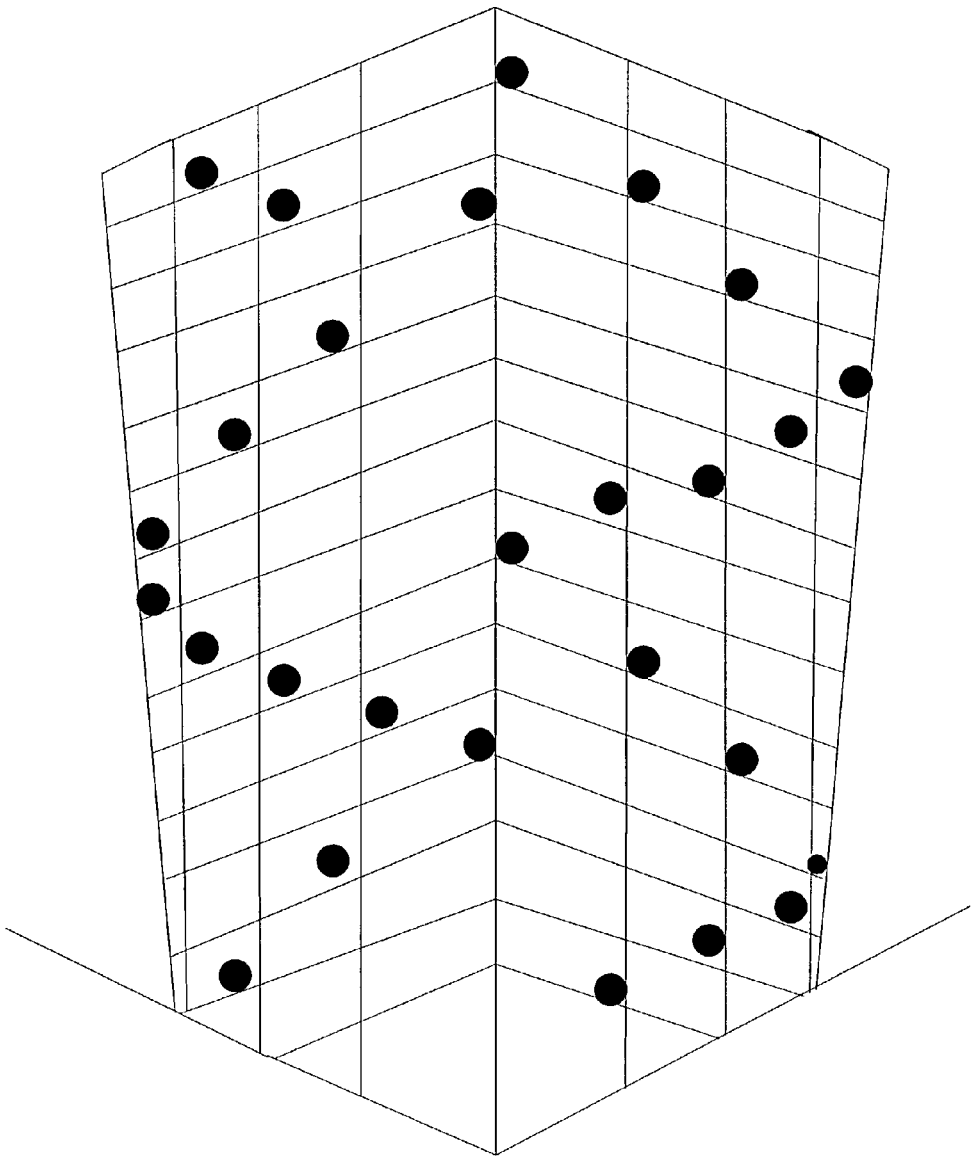
Figure 22:
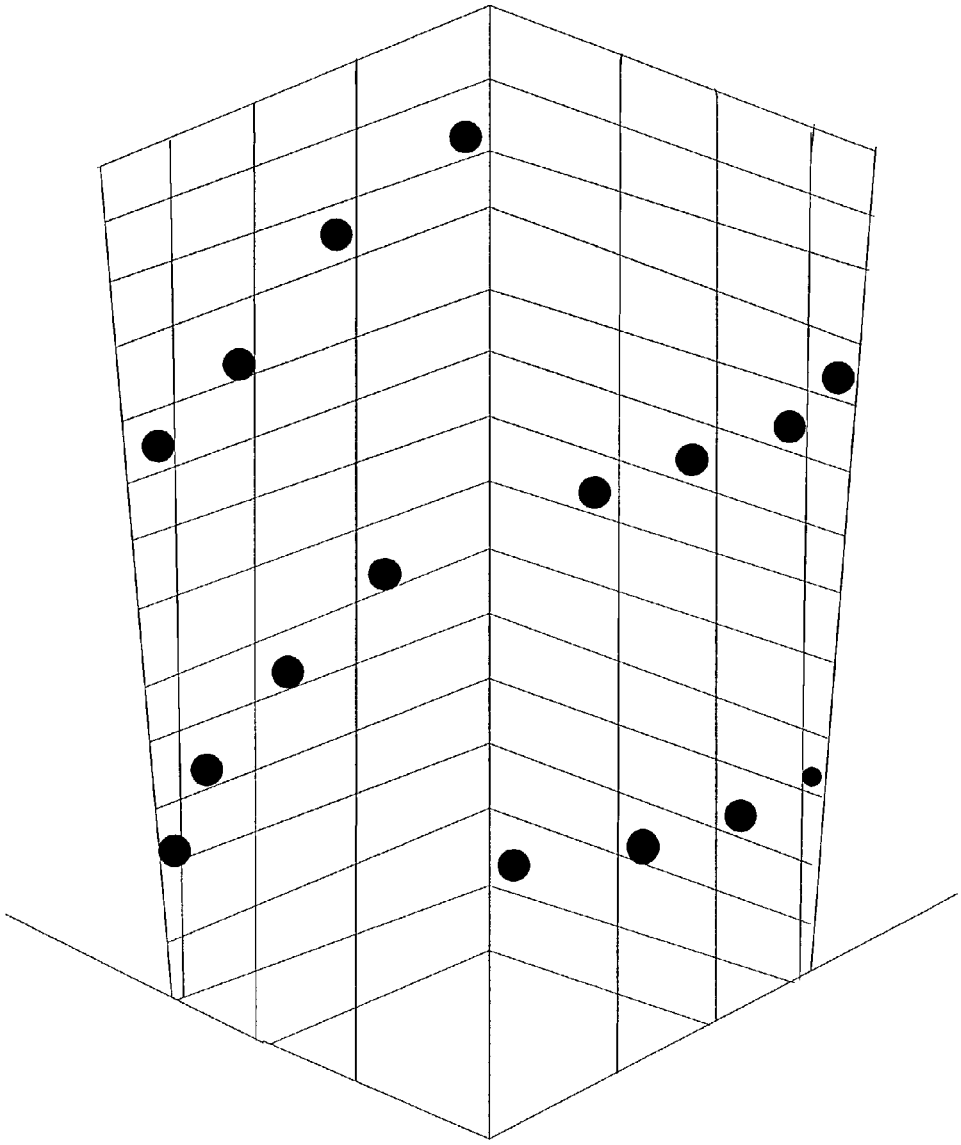

FIGS. 20–22 illustrate additional embodiments of the chevron configuration, the parallel stripes configuration, and the step configuration, in accordance with embodiments of the present invention.

As shown in FIG. 14, in the method of the present invention, the anchors are placed accordingly 1425. For example, a first anchor is placed for a floor at a height at which an individual can no longer safely jump to the ground. In one embodiment of the present invention, a first anchor of EA #1 is placed on the second U.S. story (corresponding to the first European story). The number of anchors and configuration for each face of the building is variable, for example, depending the number of people expected to populate a story and by the floor area of the story the anchor serves.

In one embodiment of the present invention, each story includes one anchor per face per story. Buildings with an exceptionally large population density (people per anchor) due to factors such as actual density (people per building footprint unit area per floor) or large footprint areas, optionally include more than one anchor per face per story. Similarly, if one or more faces of a story are unavailable for escape, extra anchors may be added to an available face. In such a case, for example, one story may be determined to be contained within two EAs. Finally, for a building having, for example, unoccupied stories, an anchor optionally is not placed on that story.

Selected aspects of the example configurations for buildings shown in FIGS. 15 and 17 will now be described in greater detail. For the example building shown in FIG. 15, EA #1 is determined to have a width and height calculated as follows:

$$W_{EA}=\text{building width of eight windows}$$

$$H_{EA}=2\times(\#\text{ exits})=2\times7=14\text{ floors.}$$

In this example, an escaping person is determined to be able to safely exit from the first U.S. floor, but unable to escape without assistance from the second and subsequent U.S. floors. Thus, EA #1 comprises the second U.S. story through the fifteenth U.S. story.

In FIG. 15, EA #2 is defined as having the following width and height:

$$W_{EA}=\text{building width of eight windows}$$

$$H_{EA}=2\times(\#\text{ exits})=2\times6=12\text{ floors.}$$

Thus, in FIG. 15, EA #2 comprises the sixteenth U.S. story to the twenty-seventh U.S. story.

In the example building shown in FIG. 17, the building has a circular cross-sectional shape or footprint (i.e., a cylindrical overall shape) having a height of 41 U.S. stories with 16 exit windows on each floor extending about the building. In this example, there are no interfering features. Because there are no interfering features, all 16 windows are used on each floor, and 16 columns of exits are defined. In this example, the ground floor and the second U.S. floor are not part of an EA because building occupants are determined to be able to climb out of the windows on these floors and safely jump to the ground.

In the example shown in FIG. 17, EA #1 is defined as having the following width and height:

$$W_{EA}=\text{building circumference of 16 windows}$$

$$H_{EA}=2\times(\#\text{ exits})=2\times16=32\text{ floors.}$$

Thus, EA #1 comprises the third U.S. floor to the thirty-fourth floor.

In FIG. 17, EA #2 is defined as having the following width and height:

$$W_{EA}=\text{building circumference of 16 windows}$$

$$H_{EA}=2\times(\#\text{ exits})=2\times16=32\text{ floors.}$$

However, in the example shown in FIG. 17, only eight floors remain for EA #2, and thus $H_{EA}$=eight floors, and EA #2 comprises the thirty-fifth U.S. floor to the forty-second U.S. floor.

Example embodiments of the present invention have now been described in accordance with the above advantages. It will be appreciated that these examples are merely illustrative of the invention. Many variations and modifications will be apparent to those skilled in the art.

What is claimed is:

1. A method for providing escape from a building, the building having a building design, the method comprising:
identifying interfering features for the building;
identifying escape routes for the building;
determining an external building escape device configuration, the configuration varying based on the identified interfering features, the identified escape routes, and the building design; and preparing the building for the external building escape device configuration;
wherein determining an external building escape device configuration includes: identifying at least one escape area for the building;
wherein the building has a plurality of floors and a ground level, wherein each of the at least one escape area includes an escape area width and an escape area height, wherein a first one of the at least one escape area is identified as including a plurality of first escape area floors between the ground level and the escape area height for the first one of the at least one escape area, and wherein a second one and each additional one of the at least one escape area has an escape area width equal to the escape area width for the first one of the at least one escape area; and
wherein each floor has a floor height, wherein the escape area width of the first one of the at least one escape area equals a width of a planar face of the building, wherein the planar face of the building includes a number of identified escape routes for the first one of the at least one escape area, and wherein the first one of the at least one escape area has a height equal to a product of the height of each floor and twice the number of identified escape routes for the first one of the at least one escape area.

2. The method of claim 1, wherein each floor has a floor height, wherein the escape area width of the first of the at least one escape area equals a circumference of the building, wherein the building includes a number of identified escape routes for the first one of the at least one escape area, and wherein the height of the first one of the at least one escape area has a height equal to a product of the height of each floor and twice the number of identified escape routes for the first one a f the at least one escape area.

3. The method of claim 1, wherein the interfering features include at least one selected from a group consisting of flagpoles, gargoyles, ledges, and statues.

4. The method of claim 1, wherein each of the escape routes includes an exit and a path below the exit.

5. The method of claim 4, wherein the exit is a building window.

6. The method of claim 4, wherein the external building escape device configuration includes a plurality of exits arranged in a chevron configuration.

7. The method of claim 4, wherein the external building escape device configuration includes a plurality of exits arranged in a parallel lines configuration.

8. The method of claim 4, wherein the external building escape device configuration includes a plurality of exits arranged in a step configuration.

9. The method of claim 6, wherein the building design includes at least one planar surface.

10. The method of claim 9, wherein the building is a quadrilateral footprint.

11. The method of claim 7, wherein the building design includes a cylindrically shaped portion.

12. The method of claim 7, wherein the building has a circular footprint.

13. The method of claim 7, wherein preparing the building for the external building escape device configuration includes:
attaching a plurality of anchors to the building.

14. The method of claim 13, wherein the building has an external surface, and wherein at least one of the plurality of anchors is attached to the external surface of the building.

15. The method of claim 13, wherein the building has an external surface, wherein at least two of the plurality of anchors are attached along a first one of the escape routes on the external surface of the building; and wherein each of the at least two of the plurality of anchors attached to the external surface of the building includes an extension arm, each extension arm extending an extension distance from the external surface of the building.

16. The method of claim 15, wherein a first one of the at least two of the plurality of anchors extends a first distance, wherein a second one of the at least two of the plurality of anchors extends a second distance, and wherein the first distance differs from the second distance.

17. The method of claim 13, wherein each of the escape routes includes a plurality of exits.

18. The method of claim 17, wherein each exit has a left side and a right side, wherein each exit has an associated anchor, and wherein at least one associated anchor is located on the left side of the exit for at least one of the plurality of exits.

19. The method of claim 13, wherein the building has a plurality of potential escapees, and wherein preparing the building for the external building escape device configuration includes:
providing an escape kit for each of the plurality of potential escapees.

20. The method of claim 4, wherein determining an external building escape device configuration, the configuration varying based on the identified interfering features, the identified escape routes, and the building design includes:
excluding from the configuration each of the identified escape routes for which one of the identified interfering features intersects.

21. The method of claim 1, wherein the building has a plurality of floors, and wherein at least one of the escape routes is provided for each of the plurality of floors.

22. A method for providing escape from a building, the building having a building design, the method comprising:
identifying interfering features for the building;
identifying escape routes for the building;
determining an external building escape device configuration, the configuration varying based on the identified interfering features, the identified escape routes, and the building design; and preparing the building for the external building escape device configuration;
wherein determining an external building escape device configuration includes:
identifying at least one escape area for the building;
wherein the building has a plurality of floors and a ground level, wherein each of the at least one escape area includes an escape area width and an escape area height, wherein a first one of the at least one escape area is identified as including a plurality of first escape area floors between the ground level and the escape area height for the first one of the at least one escape area, and wherein a second one and each additional one of the at least one escape area has an escape area width equal to the escape area width for the first one of the at least one escape area; and wherein each floor has a floor height, wherein the escape area width of the first of the at least one escape area equals a circumference of the building, wherein the building includes a number of identified escape routes for the first one of the at least one escape area, and wherein the height of the first one of the at least one escape area has a height equal to a product of the height of each floor and twice the number of identified escape routes for the first one a f the at least one escape area.

23. The method of claim 22, wherein the interfering features include at least one selected from a group consisting of flagpoles, gargoyles, ledges, and statues.

24. The method of claim 22, wherein each of the escape routes includes an exit and a path below the exit.

25. The method of claim 24, wherein the exit is a building window.

26. The method of claim 24, wherein the external building escape device configuration includes a plurality of exits arranged in a chevron configuration.

27. The method of claim 24, wherein the external building escape device configuration includes a plurality of exits arranged in a parallel lines configuration.

28. The method of claim 24, wherein the external building escape device configuration includes a plurality of exits arranged in a step configuration.

29. The method of claim 26, wherein the building design includes at least one planar surface.

30. The method of claim 29, wherein the building is a quadrilateral footprint.

31. The method of claim 27, wherein the building design includes a cylindrically shaped portion.

32. The method of claim 27, wherein the building has a circular footprint.

33. The method of claim 22, wherein the building has a plurality of floors, and wherein at least one of the escape routes is provided for each of the plurality of floors.

34. A method for providing escape from a building, the building having a building design, the method comprising:

identifying interfering features for the building;

identifying escape routes for the building;

determining an external building escape device configuration, the configuration varying based on the identified interfering features, the identified escape routes, and the building design; and preparing the building for the external building escape device configuration;

wherein each of the escape routes includes an exit and a path below the exit;

wherein the external building escape device configuration includes a plurality of exits arranged in a parallel lines configuration;

wherein preparing the building for the external building escape device configuration includes:

attaching a plurality of anchors to the building;

wherein each of the escape routes includes a plurality of exits; and wherein each exit has a left side and a right side, wherein each exit has an associated anchor, and wherein at least one associated anchor is located on the left side of the exit for at least one of the plurality of exits.

* * * * *